US010264878B1

(12) United States Patent
Liu

(10) Patent No.: US 10,264,878 B1
(45) Date of Patent: Apr. 23, 2019

(54) HANGER STAND WITH STORAGE DEVICE

(71) Applicant: METAL LIFE ENTERPRISES CO., LTD., Changhua (TW)

(72) Inventor: Lu-Yang Liu, Changhua (TW)

(73) Assignee: METAL LIFE ENTERPRISES CO., LTD., Changhua (TW)

( * ) Notice: Subject to any disclaimer, the term of this patent is extended or adjusted under 35 U.S.C. 154(b) by 0 days.

(21) Appl. No.: 16/137,254

(22) Filed: Sep. 20, 2018

(51) Int. Cl.

| | |
|---|---|
| ***A47B 61/02*** | (2006.01) |
| ***A47B 88/40*** | (2017.01) |
| ***A47B 61/00*** | (2006.01) |
| ***A47G 25/06*** | (2006.01) |
| *A47F 7/24* | (2006.01) |
| *A47F 5/13* | (2006.01) |

(52) U.S. Cl.
CPC ..... *A47B 61/02* (2013.01); *A47B 61/003* (2013.01); *A47B 88/40* (2017.01); *A47G 25/0664* (2013.01); *A47F 5/13* (2013.01); *A47F 7/24* (2013.01)

(58) Field of Classification Search
CPC ..... A47B 61/02; A47B 61/003; A47B 45/00; A47B 47/021; A47B 61/00; A47B 96/14; A47B 88/40; A47G 25/0664; A47G 25/0685; A47F 7/24; A47F 5/0006; A47F 5/10; A47F 5/0081; A47F 5/0846; A47F 5/13; A47F 5/137; B62B 2206/02; B62B 11/00; B62B 2202/65; B62B 2206/06; B62B 3/02; B65G 2201/0229
USPC ..... 280/47.34, 47.35, 79.11, 79.3; 211/206, 211/204, 175, 182, 85.3, 123, 126.15, 211/189, 207, 190; 312/237, 205, 126, 312/132, 249.8, 249.11, 249.12, 249.13, 312/128
See application file for complete search history.

(56) References Cited

U.S. PATENT DOCUMENTS

| | | | | | |
|---|---|---|---|---|---|
| 2,202,427 | A * | 5/1940 | Polen | A47B 61/02 | 211/4 |
| 2,885,090 | A * | 5/1959 | Forman | A47B 45/00 | 211/175 |
| 2,904,383 | A * | 9/1959 | Potts | A63B 55/00 | 312/237 |
| 3,620,377 | A * | 11/1971 | Holtz | A47F 5/13 | 211/182 |
| 3,921,814 | A * | 11/1975 | Solomon | A47F 7/24 | 211/124 |

(Continued)

*Primary Examiner* — Hiwot E Tefera

(57) ABSTRACT

A hanger stand with a storage device contains: a base including two horizontal connection rods, two holders, two adjustable columns, two rotatable connectors, and a horizontal hanging rod. A distance is defined between the two horizontal connection rods which have at least two pairs of orifices for screwing with at least two pairs of bolts individually, such that at least one accommodation assembly is fixed. Each of the at least one accommodation assembly includes two U-shaped frames, and each accommodation assembly includes multiple pairs of slide rails fixed inside the two U-shaped frames individually, wherein front and rear ends of the multiple pairs of slide rails do not extend beyond front and rear rims of the two U-shaped frames respectively, a covering plate is mounted on a top of each accommodation assembly, and any two opposite slide rails are fitted with a storage basket (box).

4 Claims, 5 Drawing Sheets

(56) References Cited

U.S. PATENT DOCUMENTS

| | | | | | |
|---|---|---|---|---|---|
| 4,588,096 | A * | 5/1986 | Story | B62B 3/006 | 211/126.15 |
| 5,617,962 | A * | 4/1997 | Chen | A47G 25/0664 | 211/204 |
| 5,865,517 | A * | 2/1999 | Wang | A47B 45/00 | 211/175 |
| 9,364,104 | B1 * | 6/2016 | Wood | A47F 5/0006 | |
| 2008/0029473 | A1 * | 2/2008 | Hu | A47G 25/0664 | 211/206 |
| 2008/0246377 | A1 * | 10/2008 | Huang | A47B 55/00 | 312/334.8 |
| 2017/0259837 | A1 * | 9/2017 | Arreola | B62B 3/02 | |
| 2018/0206640 | A1 * | 7/2018 | Drew | A47B 61/003 | |

* cited by examiner

HANGER STAND WITH STORAGE DEVICE

FIELD OF THE INVENTION

The present invention relates to a hanger stand with a storage device which is capable of adjusting storage space based on using requirements.

BACKGROUND OF THE INVENTION

A conventional hanger stand contains an H-shaped base including two horizontal columns and two vertical columns erected on the two horizontal columns respectively, two rotatable connectors arranged on two tops of the two vertical columns individually, and two fitting apertures defined in the two rotatable connectors respectively so as to accommodate a horizontal hanging rod.

However, such a conventional hanger stand is merely applied to hang clothes.

An improved hanger stand further contains two orifices defined through the two vertical columns respectively so as to screw with two bolts, such that a holding plate is fixed between the two vertical columns. However, a height of each of the two vertical columns is limited by each of the two bolts, and the holding plate cannot be fixed securely.

Another conventional hanger stand contains a base including two horizontal columns, two pairs of vertical columns connected with the two horizontal columns respectively, multiple slide rails locked between the two pairs of vertical columns, multiple storage baskets slidably mounted on the multiple slide rails individually.

Nevertheless, a distance between the two horizontal columns is limited, so a distance between the two pairs of vertical columns has to match with the distance between the two horizontal columns, and two ends of each of the multiple slide rails extend beyond front and rear rims of the two pairs of the vertical columns, thus causing poor appearance.

The present invention has arisen to mitigate and/or obviate the afore-described disadvantages.

SUMMARY OF THE INVENTION

The primary aspect of the present invention is to provide a hanger stand with a storage device which is capable of is capable of adjusting storage space based on using requirements, obtaining aesthetics appearance, and fixing the storage device securely.

To obtain the above aspect, a hanger stand with a storage device provided by the present invention contains: a base formed in an II shape and including two horizontal connection rods, two holders, two adjustable columns erected on the two holder respectively, two rotatable connectors mounted on two top ends of the two adjustable columns individually, and a horizontal hanging rod inserted through the two rotatable connectors.

A distance is defined between the two horizontal connection rods of the base, and the two horizontal connection rods have at least two pairs of orifices defined thereon respectively so as to screw with at least two pairs of bolts individually, such that at least one accommodation assembly is fixed by ways of the at least two pairs of orifices and the at least two pairs of bolts respectively.

Each of the at least one accommodation assembly includes two U-shaped frames arranged on two sides thereof respectively, and each accommodation assembly includes multiple pairs of slide rails fixed inside the two U-shaped frames individually, wherein front and rear ends of the multiple pairs of slide rails do not extend beyond front and rear rims of the two U-shaped frames respectively, wherein a covering plate is mounted on a top of each accommodation assembly, and any two opposite slide rails are fitted with a storage basket (box).

DETAILED DESCRIPTION OF THE PREFERRED EMBODIMENTS

Figure 1:
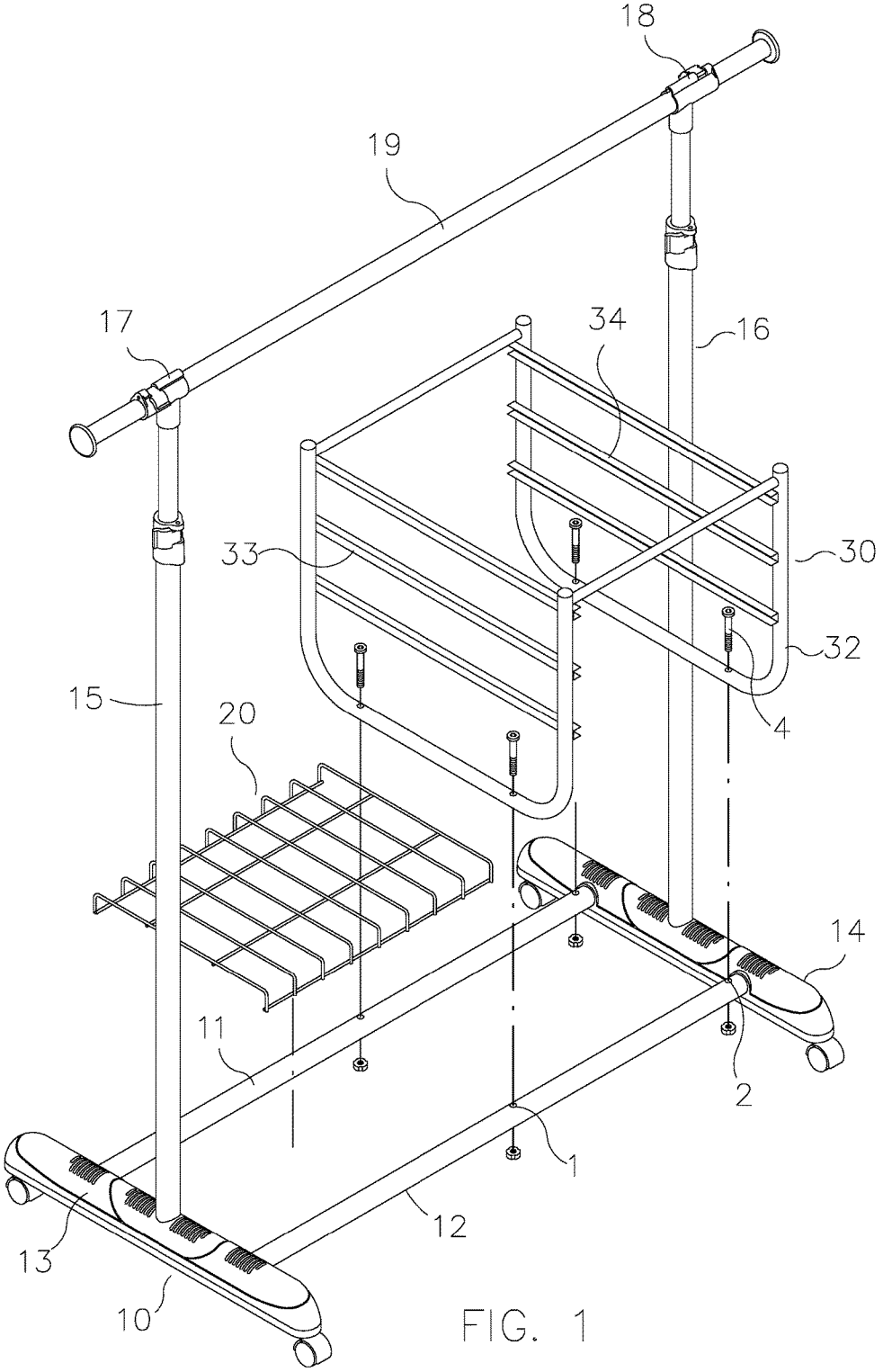
FIG. 1 is a perspective view showing the exploded components of a hanger stand with a storage device according to a first embodiment of the present invention.
Figure 2:
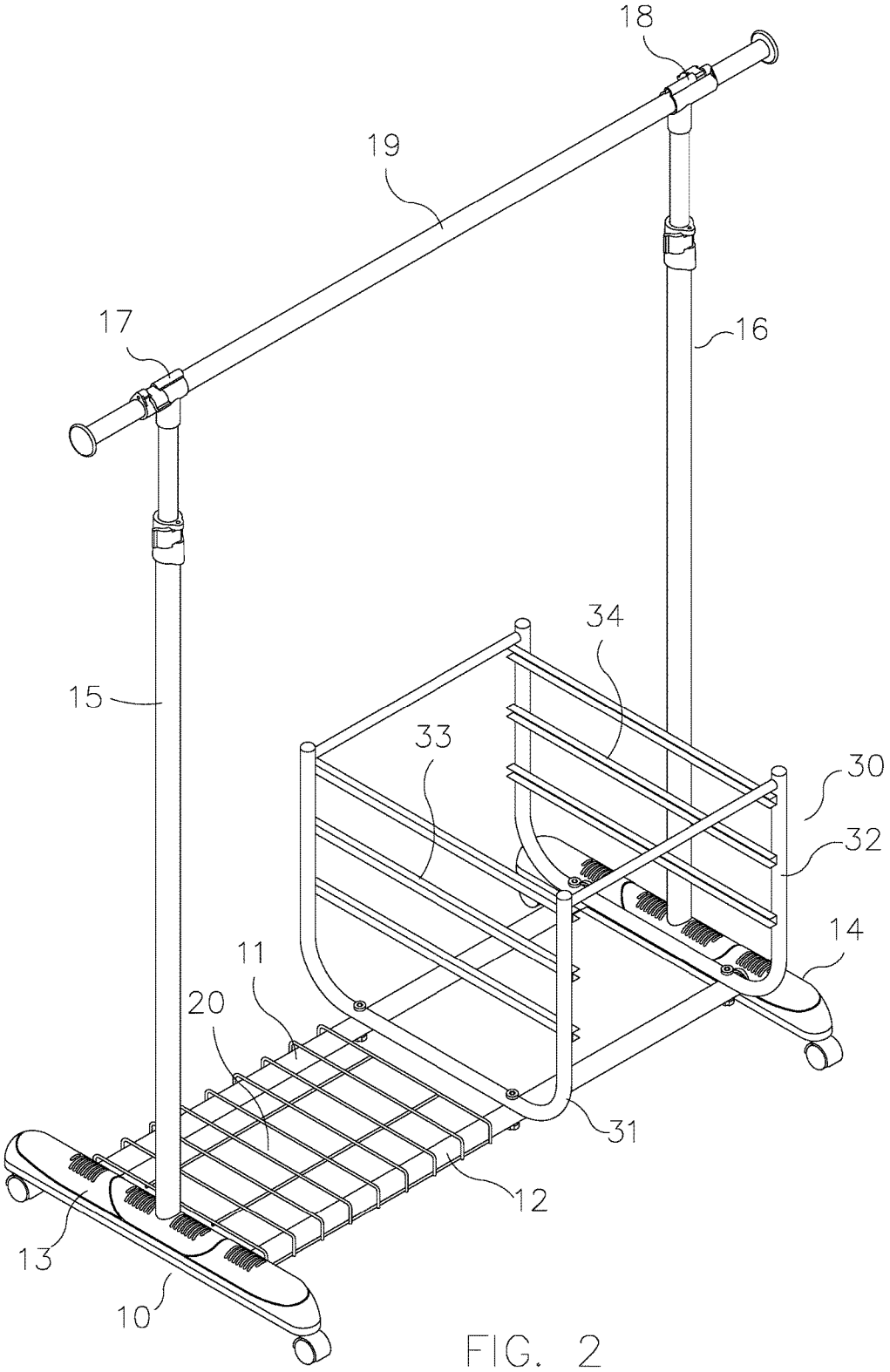
FIG. 2 is a perspective view showing the assembly of a part of the hanger stand with the storage device according to the first embodiment of the present invention.
Figure 3:
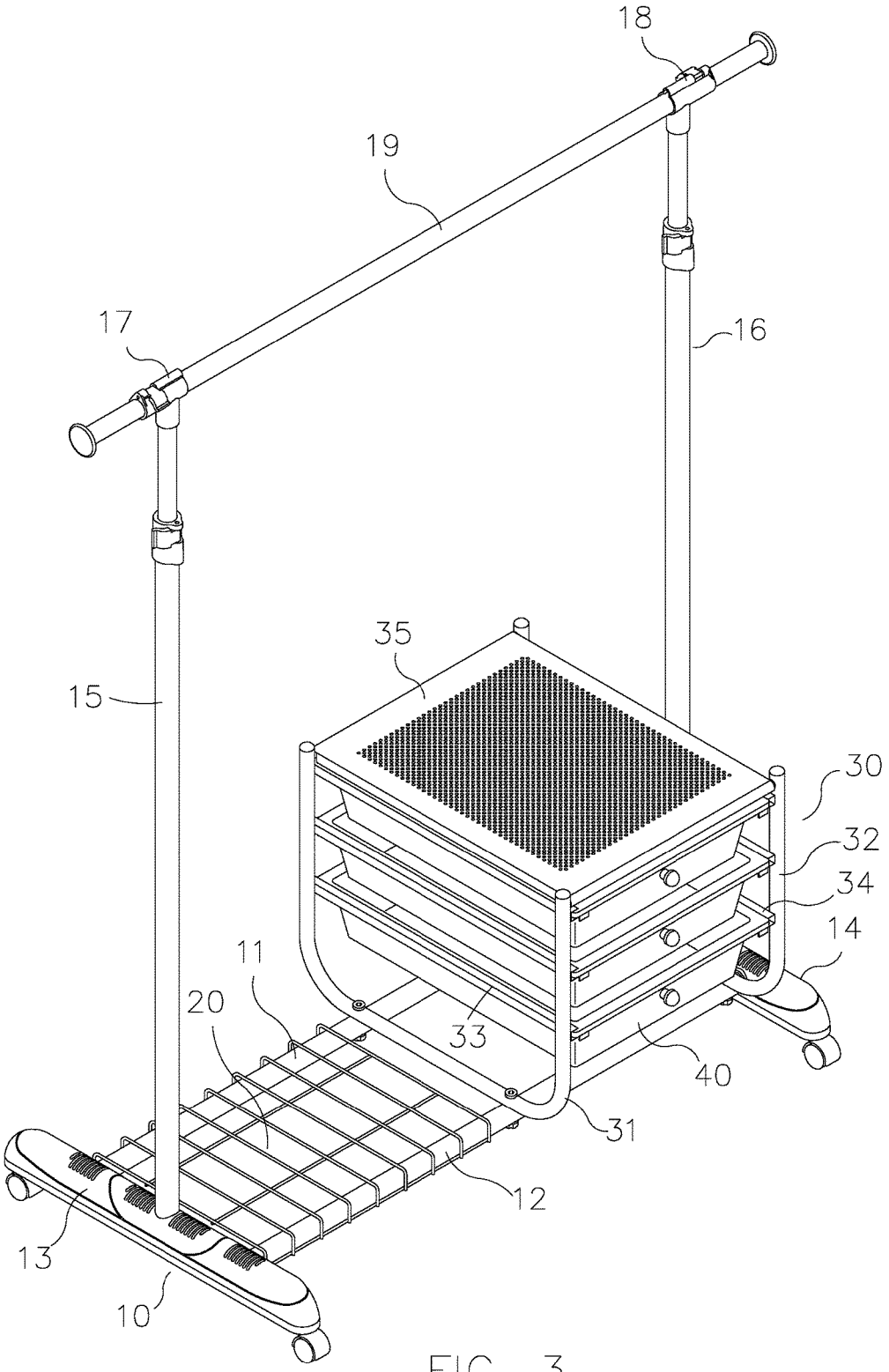
FIG. 3 is a perspective view showing the assembly of the hanger stand with the storage device according to the first embodiment of the present invention.

With reference to FIGS. 1-3, a hanger stand with a storage device according to a first embodiment of the present invention comprises: a base 10 formed in an II shape and including two horizontal connection rods 11, 12, two holders 13, 14, two adjustable columns 15, 16 erected on the two holder 13, 14 respectively, two rotatable connectors 17, 18 mounted on two top ends of the two adjustable columns 15, 16 individually, and a horizontal hanging rod 19 inserted through the two rotatable connectors 17, 18.

A distance is defined between the two horizontal connection rods 11, 12 of the base 10 so that a holding plate 20 is fixed on the two horizontal connection rods 11, 12, and the two horizontal connection rods 11, 12 have at least two pairs of orifices 1, 2 defined thereon respectively so as to screw with at least two pairs of bolts 3, 4 individually, such that an accommodation assembly 30 is fixed by ways of the at least two pairs of orifices 1, 2 and the at least two pairs of bolts 3, 4 respectively. The accommodation assembly 30 includes two U-shaped frames 31, 32 arranged on two sides thereof respectively, and the accommodation assembly 30 includes multiple pairs of slide rails 33, 34 fixed inside the two U-shaped frames 31, 32 individually, wherein front and rear ends of the multiple pairs of slide rails 33, 34 do not extend beyond front and rear rims of the two U-shaped frames 31, 32 respectively, wherein a covering plate 35 is mounted on a top of the accommodation assembly 30, and any two opposite slide rails 33, 34 are fitted with a storage basket 40 or a storage box.

Thereby, the two U-shaped frames 31, 32 are arranged on the two sides of the accommodation assembly 30 respectively, and a width of each of the two U-shaped frames 31, 32 is more than the distance between the two horizontal connection rods 11, 12, such that a size of the storage basket 40 or the storage box is not limited by the distance between the two horizontal connection rods 11, 12, and the storage basket 40 or the storage box are fitted with any two opposite slide rails 33, 34 securely. Preferably, the front and rear ends of the multiple pairs of slide rails 33, 34 do not extend beyond the front and rear rims of the two U-shaped frames 31, 32 respectively, thus obtaining aesthetics appearance of the storage device.

Figure 4:
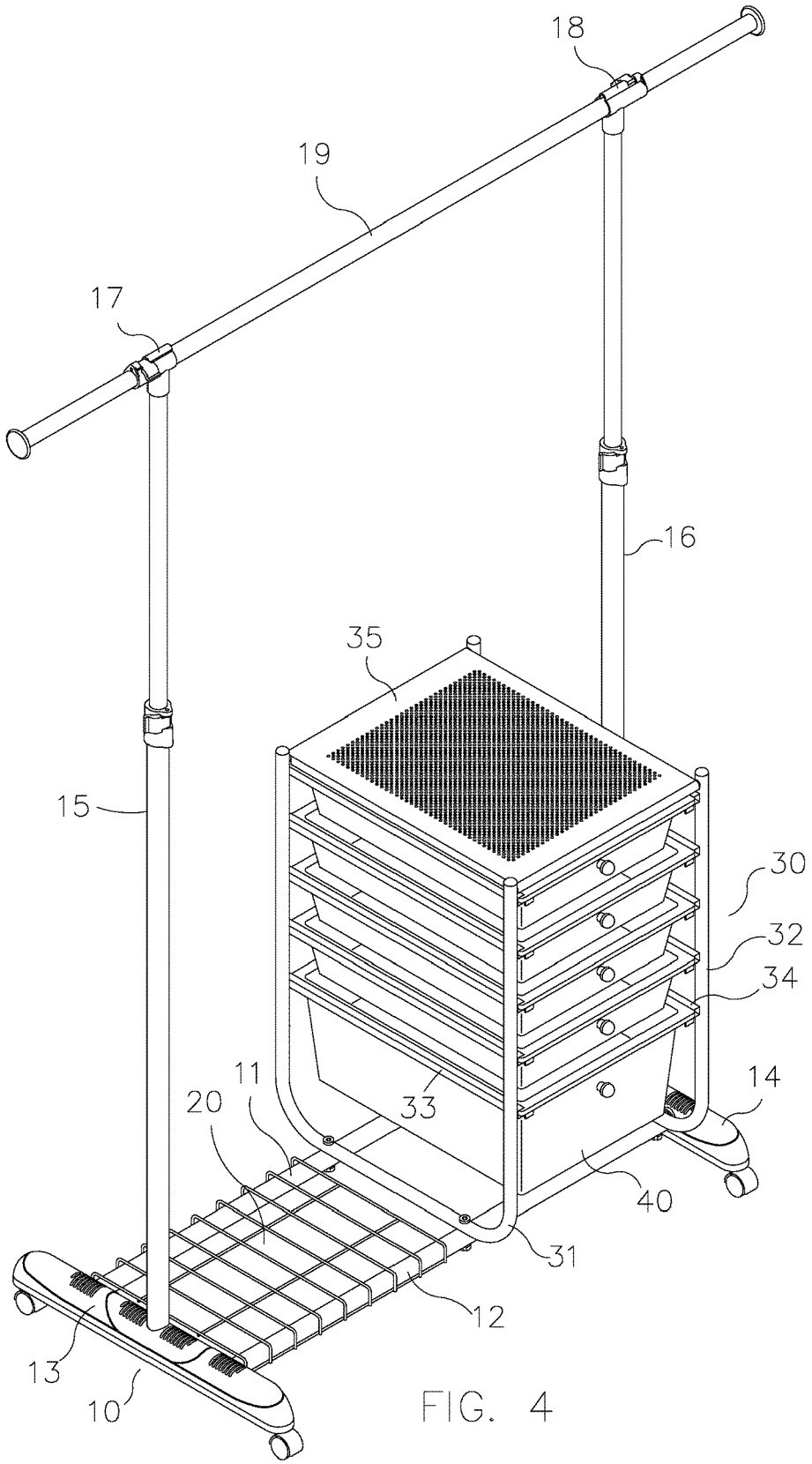
FIG. 4 is a perspective view showing the assembly of a hanger stand with a storage device according to a second embodiment of the present invention.

In a second embodiment, as shown in FIG. 4, the base 10 is formed in the II shape and the accommodation assembly 30 is fixed above the base 10, wherein the accommodation assembly 30 includes two U-shaped frames 31, 32 arranged on the two sides thereof respectively, and the accommodation assembly 30 includes multiple pairs of slide rails 33, 34 fixed inside the two U-shaped frames 31, 32 individually, wherein a height of each of the two U-shaped frames 31, 32 of the second embodiment is more than that of the first embodiment, front and rear ends of the multiple pairs of slide rails 33, 34 do not extend beyond front and rear rims of the two U-shaped frames 31, 32 respectively, wherein the covering plate 35 is mounted on the top of the accommodation assembly 30, and any two opposite slide rails 33, 34 are fitted with the storage basket 40 or the storage box, wherein a number of the multiple pairs of slide rails 33, 34 of the second embodiment is more than that of the first embodiment.

Thereby, a size or a number of at least one storage basket 40 of the present invention is adjustable based on the height of each of the two U-shaped frames 31, 32.

Figure 5:
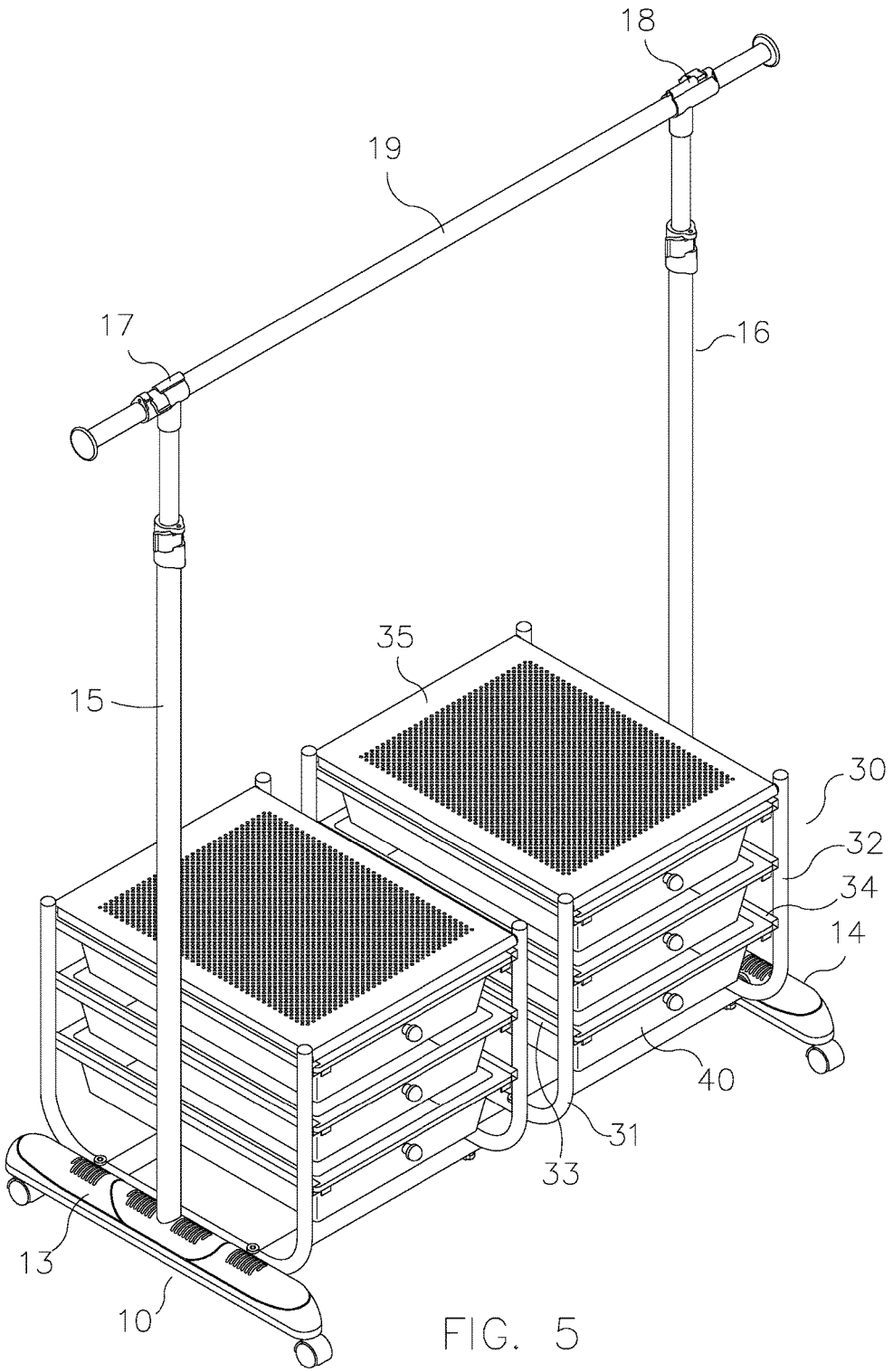
FIG. 5 is a perspective view showing the assembly of a hanger stand with a storage device according to a third embodiment of the present invention.

As illustrated in FIG. 5, in a third embodiment, another accommodation assembly 30 is fixed above the base 10 to replace the holding plate 20 of the first embodiment. Accordingly, the storage device of the present invention is adjustable according to using requirements.

Preferably, the hanger stand contains a fixed size and the body including the two horizontal connection rods on which at least one accommodation assembly is fixed, and the size or the number of the at least one storage basket is adjustable based on the height of each of the two U-shaped frames, thus enhancing a storage space of the hanger stand.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A hanger stand with a storage device comprising:

a base formed in an II shape and including two horizontal connection rods, two holders, two adjustable columns erected on the two holders respectively, two rotatable connectors mounted on two top ends of the two adjustable columns individually, and a horizontal hanging rod inserted through the two rotatable connectors;

wherein a distance is defined between the two horizontal connection rods of the base, and the two horizontal connection rods have at least two pairs of orifices defined thereon respectively so as to screw with at least two pairs of bolts individually, such that at least one accommodation assembly is fixed by ways of the at least two pairs of orifices and the at least two pairs of bolts respectively;

wherein each of the at least one accommodation assembly includes two U-shaped frames arranged on two sides thereof respectively, and each accommodation assembly includes multiple pairs of slide rails fixed inside the two U-shaped frames individually, wherein front and rear ends of the multiple pairs of slide rails do not extend beyond front and rear rims of the two U-shaped frames respectively, wherein a covering plate is mounted on a top of each accommodation assembly, and any two opposite slide rails are fitted with a storage basket (box).

2. The hanger stand as claimed in claim 1, wherein a height of each of the two U-shaped frames is changeable so as to increase or decrease a number of the multiple pairs of slide rails.

3. The hanger stand as claimed in claim 1, wherein a number of the at least one accommodation assembly is changeable so as to increase or decrease a storage space of the hanger stand.

4. The hanger stand as claimed in claim 1, wherein when a number of the at least one accommodation assembly is one, a holding plate is fixed on the two horizontal connection rods and is located beside the one accommodation assembly.

* * * * *